US008850652B2

(12) United States Patent
Lim

(10) Patent No.: US 8,850,652 B2
(45) Date of Patent: Oct. 7, 2014

(54) COSMETIC BRUSH HANDLE COVERS

(75) Inventor: Cindy Sean Yuei Lim, Santa Monica, CA (US)

(73) Assignee: HCT Asia Ltd, Central Hong Kong (HK)

( * ) Notice: Subject to any disclaimer, the term of this patent is extended or adjusted under 35 U.S.C. 154(b) by 115 days.

(21) Appl. No.: 13/292,682

(22) Filed: Nov. 9, 2011

(65) Prior Publication Data

US 2013/0111688 A1 May 9, 2013

(51) Int. Cl.

| | |
|---|---|
| ***A47L 13/50*** | (2006.01) |
| ***A46B 17/00*** | (2006.01) |
| ***A46B 17/04*** | (2006.01) |
| *A46B 5/02* | (2006.01) |
| *A46B 7/02* | (2006.01) |

(52) U.S. Cl.

CPC ..... *A46B 17/04* (2013.01); *A46B 5/026* (2013.01); *A46B 2200/1046* (2013.01); *A46B 7/023* (2013.01)

USPC ..... 15/247; 15/143.1; 15/106

(58) Field of Classification Search

CPC ..... A46B 17/00; A46B 5/00; A46B 15/0097; A46B 15/0095; A47K 1/09

USPC ..... 15/247, 106, 143.1, 167.1; 248/110, 248/683

See application file for complete search history.

(56) References Cited

U.S. PATENT DOCUMENTS

| | | | | |
|---|---|---|---|---|
| 1,899,242 | A * | 2/1933 | McNab | 248/110 |
| 4,248,543 | A | 2/1981 | Carrington et al. | |
| 5,388,599 | A * | 2/1995 | Yen | 132/311 |
| 6,145,151 | A | 11/2000 | Herron et al. | |
| 7,111,354 | B2 * | 9/2006 | Nennig et al. | 15/248.1 |
| 7,955,014 | B2 | 6/2011 | Thorpe et al. | |
| 8,292,529 | B2 * | 10/2012 | Francavilla | 401/101 |

FOREIGN PATENT DOCUMENTS

DE 29807245 U1 * 6/1998

OTHER PUBLICATIONS

The Brush Guard; http://www.thebrushguard.com/ retrieved Oct. 25, 2011, 1 page.

* cited by examiner

*Primary Examiner* — Shay Karls

(74) *Attorney, Agent, or Firm* — Lee & Hayes, PLLC

(57) ABSTRACT

Covers for covering a handle of a cosmetic brush are disclosed. The covers may include a suction cup fixed in a wall of the cover. The covers may be softer than a handle of the cosmetic brush. The covers may have an open end opposite a closed end, or a first open end opposite a second open end. In embodiments where the covers have a first open end opposite a second open end, the covers may be displaced, while remaining coupled to a handle of the cosmetic brush, from a first position covering a group of bristles of the cosmetic brush and exposing the handle of the cosmetic brush to a second position exposing the group of bristles and covering the handle. By virtue of having a suction cup fixed in the wall of the cover a user may removeably couple the cosmetic brush to a smooth surface.

19 Claims, 4 Drawing Sheets

COSMETIC BRUSH HANDLE COVERS

BACKGROUND

Covers exist for protecting bristles of cosmetic brushes. For example, covers exist that protect a group of bristles fixed at an end of a handle of the cosmetic brush. The covers may protect the group of bristles from foreign debris. Further, the covers may protect the group of bristles when the cosmetic brush is stored (e.g., while the brush is in transport). Generally, the covers keep the bristles in a desired shape and prevent debris from collecting in the bristles.

Many different types of cosmetic brush holders exist, such as soft cases, hard cases, portable cases, and the like. Some of the holders provide for hygienically holding a brush while it dries. For example, some holders may have a structure (e.g., a base), supported by a piece of furniture, which has supports for holding at least a portion of a handle of a cosmetic brush to allow the bristles of the brush to drip dry while keeping the bristles from coming in contact with a foreign surface (e.g., a table).

While these approaches may protect a group of bristles, they do not provide a gripping surface. Accordingly, there remains a need in the art for improved cosmetic brush handle covers that provide a gripping surface to a user and provides for protecting the group of bristles by providing for removeably coupling the cosmetic brush to a surface.

BRIEF DESCRIPTION OF THE DRAWINGS

The detailed description is set forth with reference to the accompanying figures. In the figures, the left-most digit(s) of a reference number identifies the figure in which the reference number first appears. The use of the same reference numbers in different figures indicates similar or identical items.

DETAILED DESCRIPTION

Overview

Figure 1:
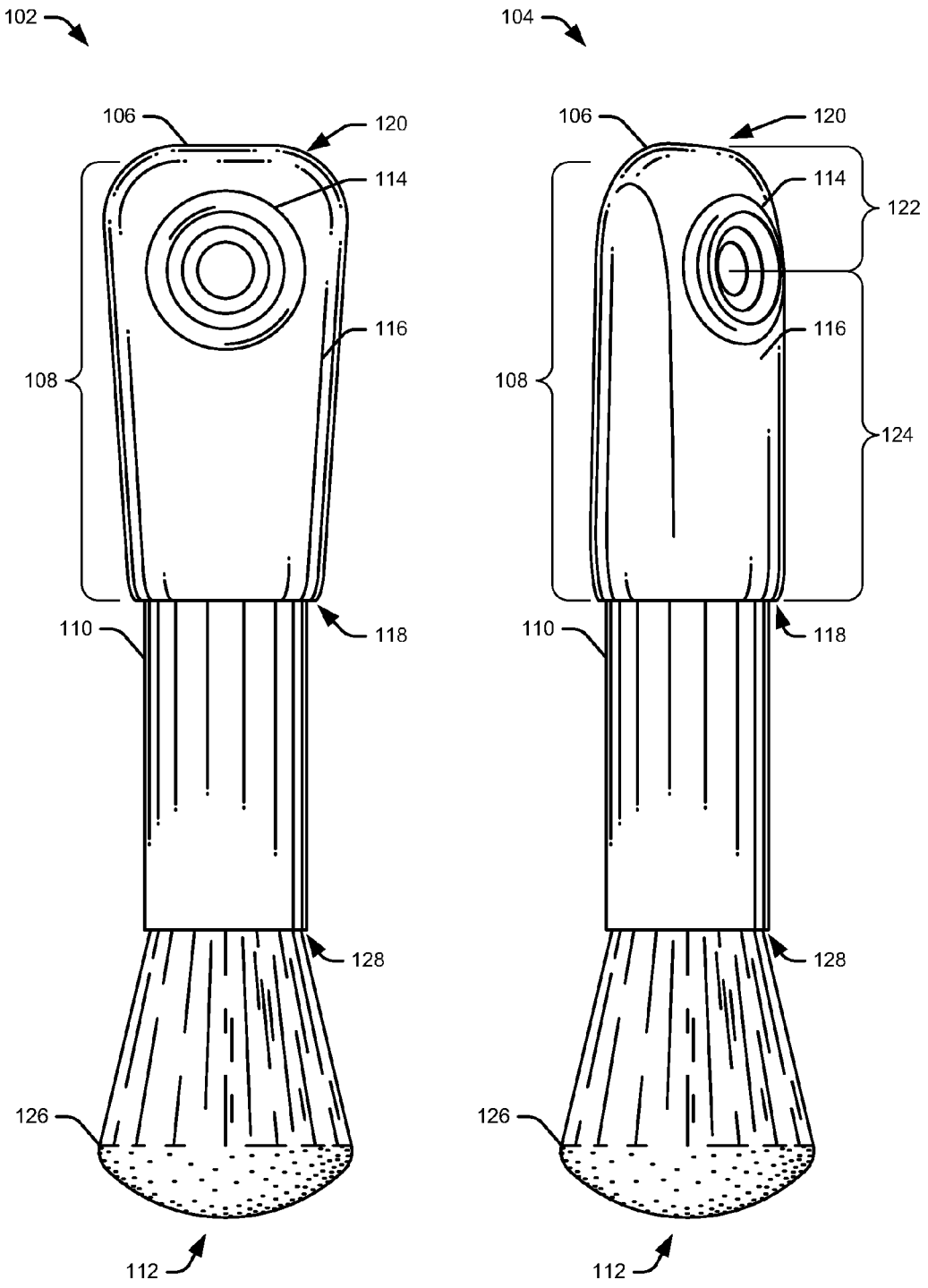
FIG. 1 depicts a front view and a perspective view of an illustrative cover encasing a portion of a handle of a cosmetic brush.

This application describes covers formed of a flexible material for cosmetic brush handles that may have a suction cup fixed in a wall of the cover. By virtue of having a cover formed of a flexible material, covers according to this disclosure are adaptable to provide a gripping surface softer than a gripping surface of a cosmetic brush handle without the cover. In addition, to providing a softer gripping surface (i.e., a comfort grip), by virtue of having a cover formed of a flexible material and a suction cup fixed in a wall of the cover, covers according to this disclosure are adaptable to removeably couple a cosmetic brush to a smooth surface. For example, a user may insert a handle of a cosmetic brush into a cover having a suction cup and subsequently removeably couple the cosmetic brush to a mirror until a time of use. While removeably coupled on the mirror, the cover will keep the group of bristles clean and intact until the user desires to apply or retouch a makeup product to portions of the user's body. Further, a user may choose to wash a cosmetic brush for hygienic purposes and removeably couple the cosmetic brush to the mirror to allow the bristles to drip dry. In this way, the cover will keep the bristles free of foreign debris and keep the bristles in a desired shape as the brush dries.

While the cover is described in various embodiments herein as being formed of a single unit of material, the cover may be formed of multiple materials. For example, a wall of the cover may be formed of one material while the suction cup may be formed of another material different from the material forming the wall. For example, the cover may comprise a suction cup, formed a first material, over-molded to a wall of the cover, formed of a second material different from the first material. Further, while the cover is described in various embodiments herein as having a suction cup formed integral with a wall of the cover, a suction cup may be fixed to the wall of the cover. For example, the suction cup may be fixed to the wall of the cover via a fastener (e.g., a screw, press fit, interference fit, etc.), an adhesive, a weld (e.g., an ultrasonic weld), or the like suitable for fixing the suction cup to the cover. Further, while the cover is described in various embodiments herein as having a uniform wall thickness, the cover may have a varying wall thickness, such as, for example, a bottom portion of the wall may have a thicker wall section than a top portion of the wall having a thinner wall section. The wall may be thicker proximate to the suction cup fixed in the wall. Further, while the cover is described throughout the application as having an elongated cylindrical shape, other types of shapes are also contemplated, such as, for example, elongated conical shape, elongated oval shape, elongated rectangle shape, elongated triangle shape, etc.

In addition, while the cover is described in various embodiments herein as comprising a single suction cup fixed to the wall of the cover, the cover may comprise any number, arrangement, and/or size of suction cups fixed to the wall of the cover. For example, a cover may have a column(s) of suction cups arranged from a top to a bottom of the cover, a ring(s) of suction cups arranged around a perimeter of the cover, or any other arrangement suitable for removeably coupling the cover to a surface via the suction cup(s). Further, a cover may be void of any suction cup. For example, a cover may not have a suction cup and may provide a comfort grip. For example, the cover may be void of any suction cup and be formed of a flexible material softer than a material forming a handle of cosmetic brush and when the cover is gripped by a user it deforms to the user's hand.

In one example, the cover may comprise an open end opposite a closed end and have a wall extending from the open end to the closed end. In another example, the cover may comprise a first open end opposite a second open end and have a wall extending from the first open to the second open end. In another example, in which the cover comprise the open end opposite the closed end the suction cup may be fixed to the wall closer to the closed end than to the open end. In another example, in which the cover comprises the first open end opposite the second open end, the suction cup may be fixed to the wall closer to the second open end than to the first open end. In another example, the suction cup may be formed integral with the wall.

In various embodiments, in which the cover comprises the first open end opposite the second open end, the cover described herein may be configured to be displaced from a first position to a second position. In the first position the cover may expose the brush handle and cover the group of bristles fixed to the handle. In the first position, the cover covering the group of bristles protects the group of bristles until the cover is moved to the second position. In the second position the cover may cover a brush handle and expose a group of bristles fixed to the brush handle. In the second position, a user may grip the cover covering the brush handle and wield the brush, and, in the second position, a user may removeably couple the cosmetic brush to a smooth surface until a time of use.

Illustrative Cosmetic Brush Handle Covers

FIG. 1 depicts a front view 102 and a perspective view 104 of an illustrative cover 106 encasing a portion 108 of a handle 110 of a cosmetic brush 112. The cover 106 may include a suction cup 114 fixed in a wall 116 of the cover 106. The wall 116 may extend from an open end 118 of the cover 106 to a closed end 120 of the cover 106. The open end 118 of the cover 106 may be arranged opposite to the closed end 120 and may receive at least the portion 108 of the handle 110.

The wall 116 may interface with the portion 108 of the handle 110 received by the open end 118. For example, the cover 106 may be an elongated cylindrically shaped vessel and an inside portion of the wall 116 forming the elongated cylindrically shaped vessel may have a smaller cross-sectional area than an outside diameter of the handle 110. As such, when the cover 106 encases the handle 110, the smaller cross-sectional area of the wall 116 interferes with the larger outside diameter of the handle 110. For example, when the cover 106 receives the portion of the handle 110, the open end 118 and the wall 116 of the cover 106 may be stretched and deformed to encase the handle 110. Subsequently, the wall 116 of the cover 106 and the handle 110 may be in direct contact with each other, creating a substantially tight interface. With the wall 116 of the cover 106 interfering with the handle 110, the cover 106 is coupled to the handle 110.

The suction cup 114 may be fixed to the wall 116 of the cover 106 closer to the closed end 120 of the cover 106 than to the open end 118 of the cover 106. For example, the suction cup 114 may be disposed a distance 122 from the closed end 120 and a distance 124 from the open end 118, where the distance 122 is smaller than the distance 124. The respective distances 122 and 124 may be measured from the center of the suction cup 114 to the respective ends 120 and 118 of the cover 106. With the suction cup 114 fixed to the wall 116 of the cover 106 closer to the closed end 120 of the cover 106 than to the open end 118 of the cover 106, the suction cup 114 may be removeably coupled to a smooth surface to hang the cosmetic brush 112 from the smooth surface. For example, because the suction cup 114 may be fixed closer to the closed end 120 than to the open end, the cover 106 may hold the cosmetic brush 112 adjacent to the smooth surface in tension against gravity. For example, the smooth surface may be a substantially vertical mirror and the cover 106 may hang the cosmetic brush 112 in tension against gravity, parallel with the vertical mirror. Further, after washing the cosmetic brush 112, the cover 106 may provide for hanging the cosmetic brush 112 upside down so water can drain out keeping an adhesive fixing the ferrule to the handle 110 intact. For example, because the cosmetic brush 112 is hung upside down via the suction cup 114, water drips from the cosmetic brush 112 and does not remain on the adhesive that fixes the ferrule to the handle 110. Because the adhesive remains intact, the ferrule remains tightly coupled to the handle 110 and does not become loose over time from washing the cosmetic brush 112. The cover 106 may be removeably coupled to a smooth surface to be stored until a later use. Further, the cover 106 may be removeably coupled to a smooth surface subsequent to washing the cosmetic brush 112 to allow a group of bristles 126 fixed to an end 128 of the handle 110 of the cosmetic brush 112 to dry. With the cover 106 removeably coupled to a smooth surface, the cover 106 may hang the cosmetic brush 112 parallel with the smooth surface and keep the group of bristles 126 clean and intact until a user desires to apply or retouch a makeup product to portions of the user's body.

While in the illustrated embodiment the group of bristles 126 is illustrated as comprising a dome-shaped group of bristles for application of loose powder and/or pressed powder products such as a blush, the group of bristles 126 may also be used to apply other products, such as foundation, mascara, or other cosmetic products and may take on other shapes, such as having multiple flat fan-shaped group of bristles, a flat rectangular-shaped group of bristles, multiple flat rectangular-shaped groups of bristles, a few individual larger bristles, or the like. Moreover, as discussed above, other, non-brush type applicators may also be used (e.g., sponges, flocking, comb, etc.).

The cover 106 may be formed of a flexible material. For example, the cover 106 may be formed of a material softer than the handle 110 of the cosmetic brush 112. The handle 110 may be formed of metal, plastic (e.g., polypropylene (PP), acrylonitrile butadiene styrene (ABS), Polyoxymethylene (POM)), glass, wood, any other suitable material, and/or combination of suitable materials for forming a handle 110 of a cosmetic brush 112. The flexible material forming the cover 106 may be a polymer (e.g., natural rubber, synthetic rubber, silicone, polychloroprene, or the like). For example, the cover 106 may be formed of a material suitably flexible to be deformed by a hand of a user gripping the cover 106 encasing the handle 110. Because a hand of a user gripping the cover 106 deforms the cover 106 between the hand of the user and the handle 110 encased by the cover 106, the cover 106 may provide a comfort grip to the user while applying makeup. Further, because the cover 106 may be formed of the flexible material (e.g., natural rubber, synthetic rubber, silicone, polychloroprene, or the like), the cover 106 prevents the handle 110 from slipping out of the cover 106. For example, because the cover 106 may be formed of a flexible material (e.g., silicone), the silicone forming the cover 106 provides a coefficient of friction sufficient to prevent the handle 110 from slipping out of the cover 106.

The cover 106 may be substantially opaque. For example, the cover 106 may be formed of a material that is opaque. Alternatively, or in addition to being formed of an opaque material, the cover 106 may have an opaque film covering the cover 106. For example, the cover 106 may have an aesthetically pleasing pattern (a floral pattern) painted and/or printed on the cover 106. Further, the cover 106 may be formed of a material that is translucent. For example, the cover 106 may be formed of a material that is transparent, clear, colorless, tinted, or the like suitable for allowing passage of a substantial amount of light so that the handle 110 encased by the cover 106 is visible through the material forming the cover 106.

Figure 2:
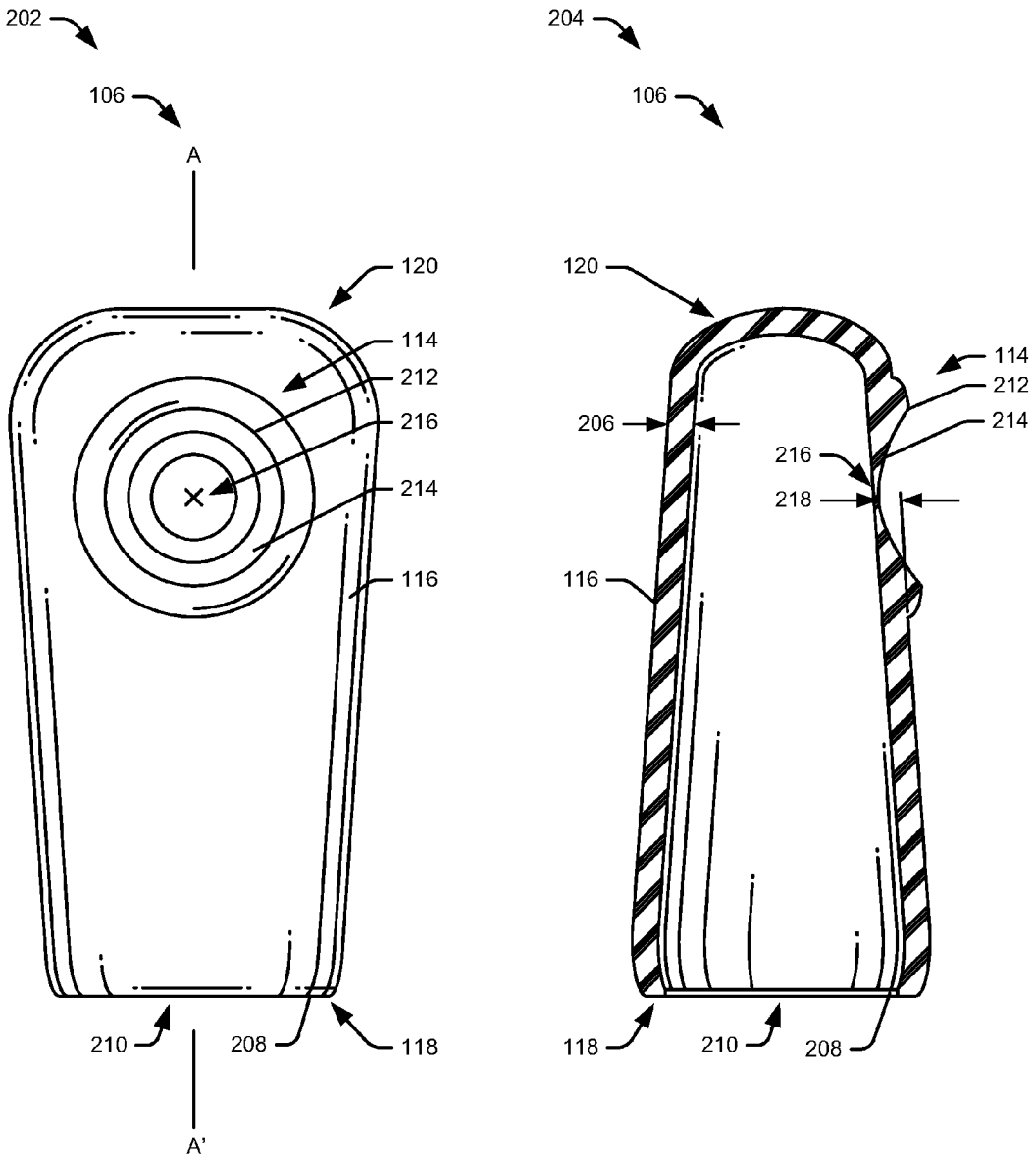
FIG. 2 depicts a front view and a section view of the cover illustrated in FIG. 1.

FIG. 2 depicts a front view 202 and a section view 204 of the cover 106 illustrated in FIG. 1. The section view 204 depicts a cross section of the cover 106 taken along line A-A' in the direction of the suction cup 114.

The wall 116 extending from the open end 118 to the closed end 120 of the cover 106 may comprise a uniform thickness 206. For example, the thickness 206 of the wall 116 may be the same from the open end 118 to the closed end 120. A rim 208 may define an aperture 210 arranged in the open end 118 of the cover 106 to receive the handle 110.

The suction cup 114 may be formed integral with the wall 116. For example, the suction cup 114 may comprise a rim 212 arranged around a curved working face 214 and the curved working face 214 may be recessed in the wall 116. For example, a vertex 216 of the curved working face 214 may be disposed a distance 218 in the wall 116. For example, the vertex 216 of the curved working face 214 may be disposed a distance 218 in the wall 116 that, in some implementations, is about 90% of the thickness 206 of the wall 116. For example, the thickness 206 of the wall 116 may be about 0.118 inches thick (3 millimeters) and the vertex 216 of the curved working face 214 may be disposed a distance 218 of about 0.106 inches (2.7 millimeters) in the wall 116. While the vertex 216 of the curved working face 214 is illustrated as being disposed a distance 218 in the wall 116 that is about 90% of the thickness 206 of the wall 116, the vertex 216 may be disposed any distance in the wall 116 suitable for forming a working face 214 in the wall 116 of the cover 106. For example, the vertex 216 may be disposed a distance 218 in the wall 116 that is about 25% of the thickness of the wall 116. In this implementation, the working face 214 of the suction cup 114 may protrude out past the wall 116. Further, the suction cup 114 and the wall 116 may be formed as a single unit of material. For example, the suction cup 114 and the wall 116 may be blow molded, injection molded, rotational molded, or the like from a single unit of material (e.g., silicone).

While the section view 204 of the cover 106 illustrates the curved working face 214 of suction cup 114 having a substantially parabolic shape, the curved working face 214 may comprise a combination of shapes. For example, the working face 214 may comprise a planar shaped bottom and a parabolic shaped wall attached to the planar bottom. Further, the working face 214 may be formed of a series of concentric parabolic shaped faces, reducing in diameter from the rim 212 to the vertex 216.

Figure 3:
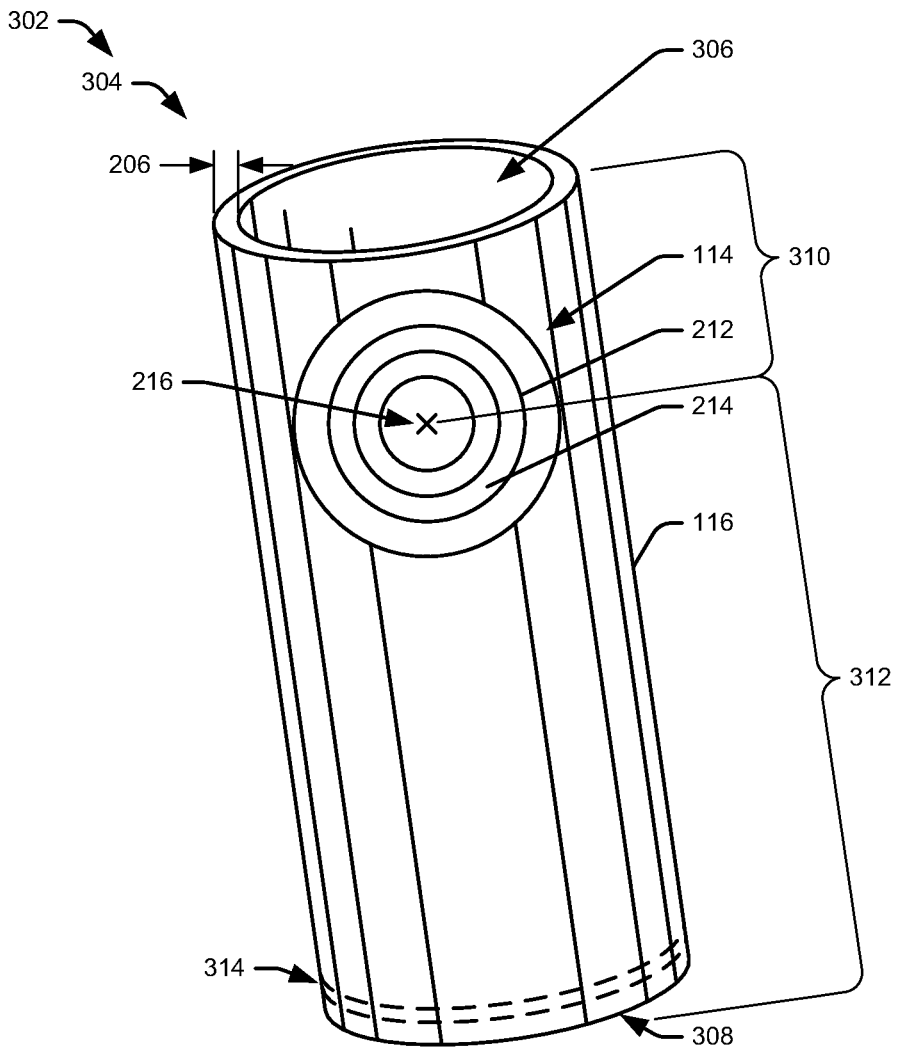
FIG. 3 depicts a perspective view of an alternative implementation of the illustrative cover having a second open end.

FIG. 3 depicts a perspective view 302 of an alternative implementation of an illustrative cover 304 having both a first open end 306 and a second open end 308. Generally, the cover 304 may comprise a cylindrically shaped tube that may cover the handle 110 of the cosmetic brush 112. The cover 304 may be formed of a flexible material to be deformed by a hand of a user gripping the cover 304 encasing the handle 110 and provide a comfort grip to the user.

The cover 304 may include the suction cup 114 which may be fixed in the wall 116 of the cover 304. The wall 116 may extend from a first open end 306 of the cover 304 to the second open end 308 of the cover 304. The first open end 306 of the cover 304 may be arranged opposite to the second open end 308 and both the first open end 306 and the second open end 308 may receive a portion of the handle 110 of the cosmetic brush 112.

The suction cup 114 may be fixed to the wall 116 of the cover 304 closer to the second open end 308 of the cover 304 than to the first open end 306 of the cover 304. For example, the suction cup 114 may be disposed a distance 310 from the second open end 308 and a distance 312 from the first open end 306, where the distance 310 is smaller than the distance 312. For example, the distance 310 may be ¼ of the distance 312, ⅓ of the distance 312, ⅜ of the distance 312, or any other ratio such that the distance 310 is smaller than the distance 312. With the suction cup 114 fixed to the wall 116 of the cover 304 closer to the second open end 308 than to the first open end 306, the suction cup 114 may be selectively positioned proximate to an end of the handle 110 of the cosmetic brush 112 opposite to the end 128 of the handle 110 having the group of bristles 126. With the cover 304 encasing the handle 110, a user may then removeably couple the cover 304 to a smooth surface.

As discussed above with respect to FIG. 2, the wall 116 may comprise the uniform thickness 206 and the suction cup 114 may be formed integral with the wall 116. For example, the vertex 216 of the curved working face 214 may be disposed the distance 218 in the wall 116 and the curved working face 214 may be recessed in the wall 116.

The cover 304 may comprise a fastening mechanism 314 disposed proximate to the first open end 306 of the cover 304. The fastening mechanism 314 may couple the first open end 306 of the cover 304 adjacent to the group of bristles 126 fixed in the end 128 of the handle 110 of the cosmetic brush 112. The fastening mechanism 314 may comprise a rib arranged around the first open end 306 of the cover 304. The rib may have an inner diameter smaller than an outer diameter of the end 128 of the handle 110. Because the rib has a smaller inner diameter than the outer diameter of the end 128 of the handle 110, the rib interferes with the outer diameter of the handle 110, coupling the cover 304 to the handle 110 adjacent to the group of bristles 126. Further, the rib may be formed integral with the first open end 306 of the cover 304. For example, the rib and the cover 304 may be blow molded, injection molded, rotational molded, or the like from a single unit of material.

Figure 4:
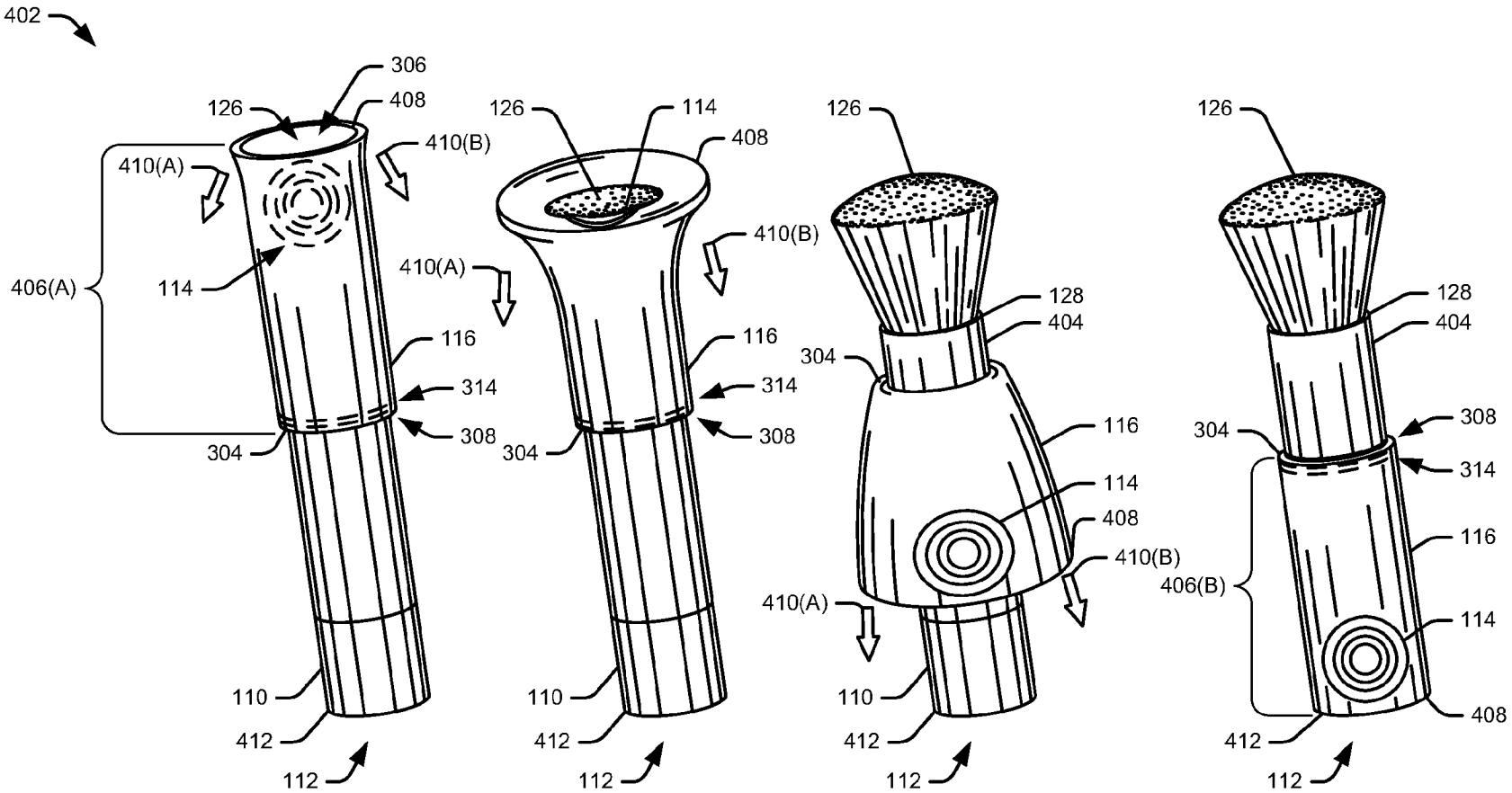
FIG. 4 illustrates a perspective view of an implementation of the cover in FIG. 3.

FIG. 4 illustrates a perspective view 402 of an implementation of the cover 304 in FIG. 3. As discussed above, the cover 304 may be formed of a flexible material to be deformed by a hand of a user gripping the cover 304 encasing the handle 110 providing a comfort grip to the user. Further, and as illustrated in FIG. 4, the cover 304 may be formed of a flexible material to be deformed and displaced back over itself while remaining coupled to the handle 110.

As discussed above with respect to FIG. 3, the fastening mechanism 314 of the cover 304 may interfere with the outer diameter of the handle 110, coupling the cover to the handle 110 adjacent to the group of bristles 126. For example, the fastening mechanism 314 of the cover 304 may comprise a rib having smaller inner diameter than the outer diameter of the end 128 of the handle 110 that interferes with the outer diameter of the handle 110, coupling the cover 304 to the handle 110. Further, the rib may have a smaller inner diameter than the outer diameter of the end 128 of the handle 110 and may be received by a notch, a groove, a captive grove (e.g., a dove-tail groove) arranged along the interface of the handle 110 and an end of a ferrule 404, coupling the cover 304 to the handle 110.

The flexible material forming the cover 304 may be coupled to the handle 110 to peel from a first position 406(A) covering the group of bristles 126 and exposing the handle 110 to a second position 406(B) exposing the group of bristles 126 and covering the handle 110. For example, a user may deform a lip 408 of the second open end 308 of the cover 304 in the direction of arrows 410(A) and 410(B), back over the cover 304, and down to a bottom end 412 of the handle 110 opposite to the group of bristles 126. Further, a user may deform the lip 408 back over the cover 304, in the opposite direction of the arrows 410(A) and 410(B), back and over the group of bristles 126.

In the first position 406(A), with the cover 304 covering the group of bristles 126, the suction cup 114 may be disposed inside the cover 304 and adjacent to the group of bristles 126. In the second position 406(B), with the cover 304 covering the handle 110, the suction cup 114 may be disposed outside the cover 304 and adjacent to the bottom end 412 of the handle 110.

When in the second position 406(B), a user may grip the cover 304 covering the handle 110 and apply or retouch a makeup product to portions of the user's body. Further, and also when in the second position 406(B), a user may removeably couple the cosmetic brush 112 to a smooth surface, via the exposed suction cup 114, until user desires to apply or retouch a makeup product to portions of the user's body. When in the first position 406(A), the cover 304 protects the group of bristles 126, keeping the group of bristles 126 clean and intact until a user desires to apply or retouch a makeup product to portions of the user's body.

CONCLUSION

Although embodiments have been described in language specific to structural features and/or methodological acts, it is to be understood that the disclosure is not necessarily limited to the specific features or acts described. Rather, the specific features and acts are disclosed as illustrative forms of implementing the embodiments. For example, in various embodiments, any of the structural features and/or methodological acts described herein may be rearranged, modified, or omitted entirely. For example, the shape, size, and configuration of the cover, handle, and group of bristles may be varied.

What is claimed is:

1. A cover for encasing a handle of a cosmetic brush, the cover comprising:

an open end opposite a closed end, the open end to receive at least a portion of the handle of the cosmetic brush;

a wall extending from the open end to the closed end, the wall to interface with the portion of the handle received by the open end; and a suction cup formed integral with the wall of the cover, wherein the suction cup comprises a rim arranged around a curved working face, the rim fixed to an outside surface of the wall of the cover and formed integral with the wall of the cover, the rim comprising a substantially convex shaped protrusion, formed integral with the wall of the cover, that protrudes from an outside surface of the wall of the cover away from the curved working face, and the curved working face is at least partially recessed in the wall of the cover.

2. The cover according to claim 1, wherein the suction cup is fixed to the wall of the cover closer to the closed end than to the open end.

3. A cover for a handle, the cover comprising:

an elongated cylindrically shaped vessel to encase the handle, the cylindrical vessel comprising:

a rim defining an aperture arranged in an open end of the cylindrical vessel to receive the handle;

a wall extending from the rim to a closed end of the cylindrical vessel, the wall to interface with the handle from the rim to the closed end of the cylindrical vessel; and a suction cup at least partially recessed in the wall of the cylindrical vessel closer to the closed end than to the rim, wherein the suction cup comprises a rim arranged around a curved working face, and a vertex of the curved working face is formed integral with the wall of the cylindrical vessel and disposed a distance in the wall of the cylindrical vessel.

4. The cover according to claim 3, wherein the suction cup and the wall are formed as a single unit of material.

5. The cover according to claim 3, wherein the suction cup and the wall are formed of a polymer.

6. The cover according to claim 5, wherein the suction cup and the wall are formed of a silicone.

7. The cover according to claim 3, wherein the cylindrical vessel is opaque.

8. The cover according to claim 3, wherein the cylindrical vessel is translucent.

9. The cover according to claim 3, wherein the distance the vertex of the curved working face is disposed in the wall of the cylindrical vessel is about 90% of a thickness of the wall of the cylindrical vessel.

10. A cover for a brush handle, the cover comprising:

a tube having a wall extending between a first open end and a second open end;

a suction cup fixed to the wall of the tube;

a fastening mechanism to couple the first open end of the tube to the brush handle and adjacent to a group of bristles fixed in an end of the brush handle; and wherein the tube is configured to be displaced, while remaining coupled to the brush handle, from a first position covering the group of bristles and exposing the brush handle to a second position exposing the group of bristles and covering the brush handle.

11. The cover according to claim 10, wherein the suction cup is fixed to the wall of the tube closer to the second open end than to the first open end.

12. The cover according to claim 10, wherein the suction cup is formed integral with the wall of the tube and the suction cup and the wall of the tube are formed as a single unit of material.

13. The cover according to claim 10, wherein the suction cup comprises a rim arranged around a curved working face, and wherein the curved working face is at least partially recessed in the wall of the tube.

14. The cover according to claim 10, wherein the suction cup and the wall of the tube are formed as a single unit of a polymer.

15. The cover according to claim 14, wherein the suction cup and the wall are formed of a silicone.

16. The cover according to claim 10, wherein the fastening mechanism comprises a rib arranged around the first open end of the tube, the rib having an inner diameter smaller than an outer diameter of the brush handle, wherein the smaller inner diameter of the rib interferes with the outer diameter of the brush handle coupling the tube to the brush handle.

17. The cover according to claim 16, wherein the rib is formed integral with first open end of the tube.

18. The cover according to claim 10, wherein when the tube is in the first position the suction cup is adjacent to the group of bristles, and when the tube is in the second position the suction cup is adjacent to the brush handle.

19. The cover according to claim 18, wherein when the suction cup is adjacent to the group of bristles a curved working face of the suction cup is oriented towards the group of bristles, and when the suction cup is adjacent to the brush handle the curved working face of the suction cup is oriented away from the brush handle.

* * * * *